US005700376A

United States Patent [19]

Carpenter

[11] Patent Number: 5,700,376

[45] Date of Patent: Dec. 23, 1997

[54] METHOD AND APPARATUS FOR MAGNETICALLY TREATING FLOWING LIQUIDS

[76] Inventor: Roland K. Carpenter, 251 W. Canal Dr., Palm Harbor, Fla. 34684

[21] Appl. No.: 605,193

[22] PCT Filed: Oct. 20, 1994

[86] PCT No.: PCT/US94/12014

§ 371 Date: Mar. 1, 1996

§ 102(e) Date: Mar. 1, 1996

[87] PCT Pub. No.: WO95/11198

PCT Pub. Date: Apr. 20, 1995

[51] Int. Cl.[6] ..... E21B 37/00; C02F 1/48

[52] U.S. Cl. ..... 210/695; 210/222; 166/66.5; 166/304

[58] Field of Search ..... 210/222, 695; 166/665, 304

[56] References Cited

U.S. PATENT DOCUMENTS

| | | | |
|---|---|---|---|
| D. 107,460 | 12/1937 | Spence | D7/502 |
| D. 171,939 | 4/1954 | Hubsch | D7/502 |
| D. 216,214 | 12/1969 | Daenen | D7/502 |
| D. 241,936 | 10/1976 | Rosaen | D23/209 |
| D. 242,920 | 1/1977 | Csurgay | D23/207 |
| D. 262,306 | 12/1981 | Carpenter | D23/207 |
| D. 262,987 | 2/1982 | Carpenter | D7/502 |
| 531,183 | 12/1894 | Harris | 210/222 |
| 1,401,130 | 12/1921 | Billon et al. | 335/302 |
| 2,329,893 | 9/1943 | Girard | 210/222 |
| 2,380,560 | 7/1945 | Urquhart | 335/302 |
| 2,607,492 | 8/1952 | Anders | 210/222 |
| 2,612,268 | 9/1952 | Merwin | 209/223.1 |
| 2,652,925 | 9/1953 | Vermeiren | 210/222 |
| 2,782,369 | 2/1957 | Werner et al. | 324/701 |
| 3,197,402 | 7/1965 | Ruskin | 210/222 |
| 3,228,878 | 1/1966 | Moody | 210/222 |
| 3,463,729 | 8/1969 | Bean | 210/222 |
| 3,637,033 | 1/1972 | Mayall | 166/66.5 |
| 3,923,660 | 12/1975 | Kottmeier | 210/222 |
| 4,157,963 | 6/1979 | Jessop et al. | 210/222 |
| 4,210,535 | 7/1980 | Risk | 210/222 |
| 4,265,746 | 5/1981 | Zimmerman, Sr. et al. | 210/222 |
| 4,265,754 | 5/1981 | Menold | 210/222 |
| 4,265,755 | 5/1981 | Zimmerman | 210/222 |
| 4,367,143 | 1/1983 | Carpenter | 210/222 |
| 4,572,145 | 2/1986 | Mitchell et al. | 210/222 |
| 4,605,498 | 8/1986 | Kulish | 210/222 |
| 4,888,113 | 12/1989 | Holcomb | 210/222 |
| 4,946,590 | 8/1990 | Hertzog | 210/222 |
| 4,956,084 | 9/1990 | Stevens | 210/222 |
| 4,995,425 | 2/1991 | Weisenbarger et al. | 210/222 |
| 5,012,842 | 5/1991 | Savard | 138/99 |
| 5,024,271 | 6/1991 | Meihua | 166/66.5 |
| 5,052,491 | 10/1991 | Harms et al. | 210/695 |
| 5,078,870 | 1/1992 | Carpenter | 210/222 |
| 5,198,106 | 3/1993 | Carpenter | 210/222 |
| 5,238,558 | 8/1993 | Curtis | 210/222 |

FOREIGN PATENT DOCUMENTS

| | | |
|---|---|---|
| 1155086 | 10/1983 | Canada . |
| 0319936 | 6/1989 | European Pat. Off. . |
| 0616977 | 9/1994 | European Pat. Off. . |
| 9116358 | 8/1992 | Germany . |
| 9400751 | 3/1994 | Germany . |
| 9010598 | 9/1990 | WIPO . |

*Primary Examiner*—David A. Reifsnyder
*Attorney, Agent, or Firm*—Peterson, Wicks, Nemer & Kamrath, P.A.

[57] ABSTRACT

An apparatus and method is disclosed including first and second housing halves which are welded together to attach the apparatus to a pup joint installed in an oil casing. The housing includes a cylindrical portion and first and second frustoconical portions at opposite axial ends thereof. Axially extending L-shaped spacers are secured to the inside portion and include longitudinal edges which abut with the outer surface of the pipe. Series of axially spaced, first and right parallelepiped shaped magnets are sandwiched between the inside portion of the cylindrical portion and the outer surface of the pipe, with the poles of the first and magnets being reversed relative to the pipe. The housing halves are welded along their longitudinal free edges after being clamped together by a clamping band with sufficient force to secure the apparatus to the pipe generally by frictional forces and being free of the attachment to the pipe.

23 Claims, 1 Drawing Sheet

METHOD AND APPARATUS FOR MAGNETICALLY TREATING FLOWING LIQUIDS

BACKGROUND

1. Field of the Invention

This invention relates generally to apparatus for magnetically treating a liquid flowing through a pipe, and pertains more particularly to unpotted apparatus that can be readily held in place against the exterior of the tubing string installed in an oil well casing pipe.

2. Description of the Prior Art

Perhaps U.S. Pat. Nos. 4,367,143; 5,078,870; and 5,198,106 are representative of the state-of-the-art. However, as mentioned in the aforementioned issued patents, U.S. Pat. No. 3,328,878 also is representative of earlier prior art. The disclosures of each of these patents mention scale and paraffin problems, pointing out that scale can take various forms but typical of the substances creating scale problems are calcium carbonate, calcium sulfate, barium sulfate, sodium chloride, magnesium sulfate, silica, as well as various oils, waxes and greases in addition to paraffin. Accumulations of these substances on the interior Of the pipe obviously produce problems, especially as far as causing a greater resistance to liquid flow within the pipe, and also where heat is applied to the pipe's exterior, the collected substances act as an objectionable thermal insulator. Sufficient accumulations, quite obviously, require that, the piping system be inactivated and the pipes individually cleaned out, a time-consuming and costly procedure where the system is an industrial one, particularly due to the fact that the particular piping system is not productive during the shutdown period.

The polarization of diamagnetic materials through the agency of relatively strong magnetic fields provided by permanent magnetic means is generally well understood and need not be repeated at this time, although reference may be made to the patents herein referred to for a basic understanding of what is involved. Very succinctly, however, the principle behind the polarization is to prevent the formation of sufficiently objectionable deposits on the inside of the pipe, the magnetic action causing the diamagnetic materials to move inwardly under the influence of a sufficiently strong magnetic field.

The difficulty in the past, however, has been with respect to providing sufficiently strong magnetic fields on the tubing string installed in an oil well casing pipe. Such tubing string is prone to incrustation of paraffin, asphaltine scale/deposits along with salt water and hard water deposits. Presently, chemicals are injected into the oil wells to prevent deposits from plugging the tubing string. However, when this method fails, the tubing string is removed from the oil well at great expense and cleaned out after its removal from the oil well. Attempts to treat the flow through the tubing string to prevent incrustation have not proven successful. First, the spacing between the tubing string and the oil well casing pipe is very restrictive and does not allow use of magnetic units which are conventionally utilized for exposed pipes. Further, the tubing string is typically formed of Schedule 80 carbon steel and is tested for 3,000 psi (210 kg/sq. cm) and 175,000 pounds (65,000 kg) of tensile strength, and therefore transmission of magnetic flux through the tubing string is relatively difficult. Furthermore, installation of the tubing string is sometimes 17,000 feet (5,000 meters) below the surface and is not in a straight line. Thus, considerable force estimated to be in the range of 20,000 pounds (7,500 kg) is exerted during installation on the side of the tubing string and/or upon any accessories mounted thereto.

It is thus an object of the present invention to provide a novel apparatus for magnetically treating liquids flowing through the tubing string installed in a well casing pipe.

It is further an object of the present invention to provide such a novel magnetic apparatus which is attached to a pup joint without physical alteration of the pup joint.

It is further an object of the present invention to provide such a novel magnetic apparatus which is secured on the pipe solely by frictional forces.

It is further an object of the present invention to provide such a novel magnetic apparatus which is able to withstand the rigors of installation thousands of feet (meters) below the surface.

SUMMARY

Surprisingly, these objects and other aims can be satisfied in the field of magnetically treating flowing liquids by providing, in the most preferred form, a plurality of parallel spacers secured at circumferentially spaced locations to the inside surface of the cylindrical portion of a housing, with series of axially spaced, first and second magnets being sandwiched between the inside surface of the cylindrical portion of the housing and the outer surface of the pipe and circumferentially spaced from each other and from the spacers, with the poles of the first and second magnets being reversed relative to the pipe.

In a further aspect of the present invention, first and second, radially separable portions of a magnetic apparatus are clamped on a pipe and then secured together with sufficient force to secure the magnetic apparatus to the pipe generally by frictional forces between the magnetic apparatus and the pipe and without attachment of the magnetic apparatus to the pipe. In a preferred form, the pipe with the magnetic apparatus so secured thereon is inserted within a casing pipe of a diametric size larger than the pipe and the magnetic apparatus secured thereon.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
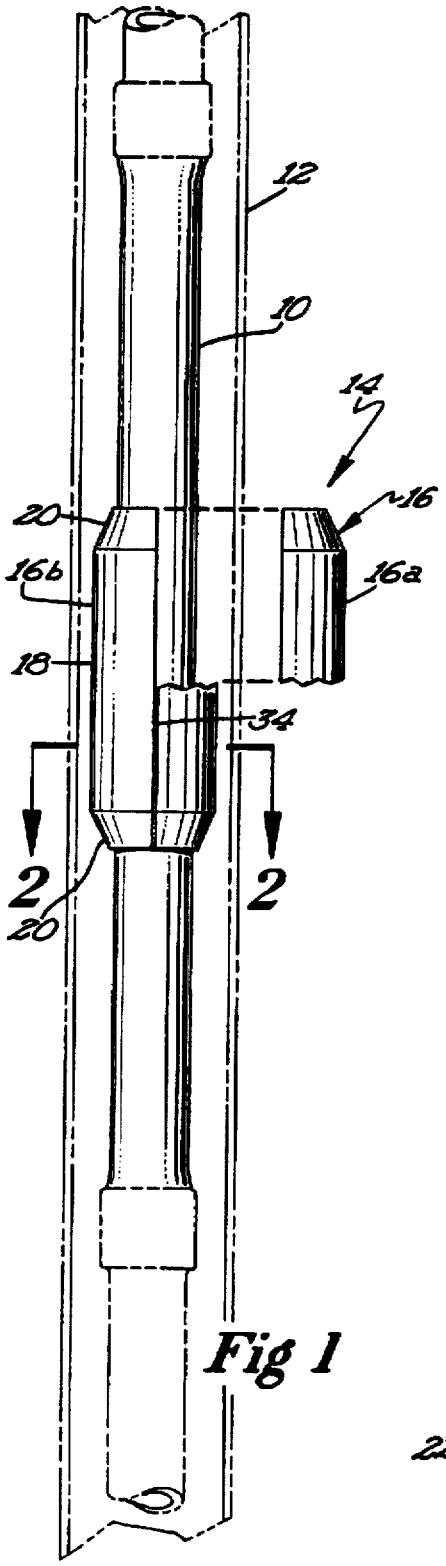
FIG. 1 shows an elevational view of a magnetic apparatus secured to a pup joint pipe of a well pipe tubing string installed in an oil well casing pipe according to the preferred teachings of the present invention, with portions exploded therefrom.
Figure 3:
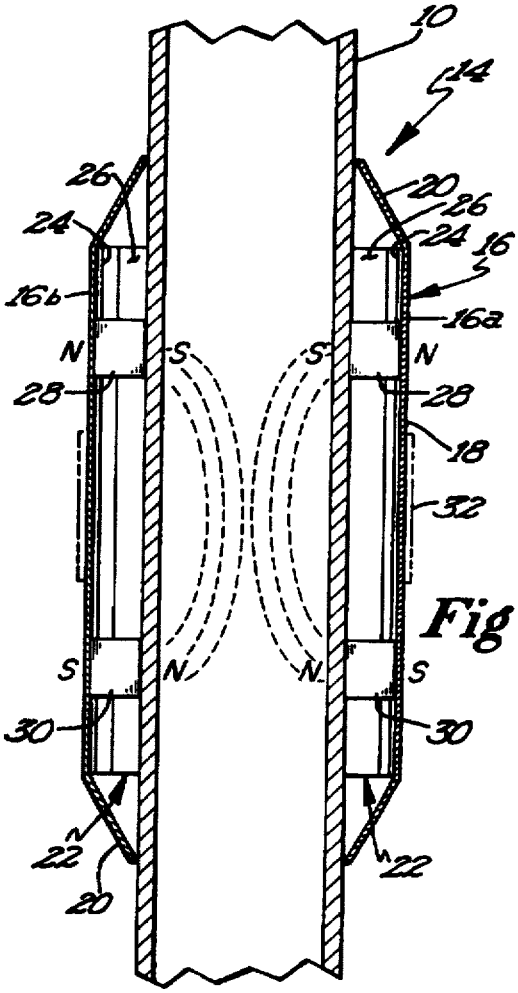
FIG. 3 shows a vertical sectional view of the apparatus of FIG. 1 according to section line 3—3 of FIG. 2.
Figure 2:
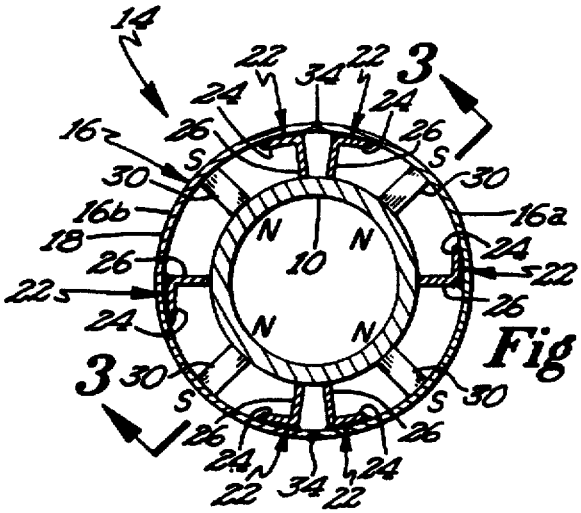
FIG. 2 shows a horizontal sectional view of the apparatus of FIG. 1 according to section line 2—2 of FIG. 1.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "inside", "outside", "outer", "inner", "upper", "lower", "height", "width", "length", "end", "side", "horizontal", "vertical", "longitudinal", "axial", "circumferential", "radial", and similar terms are used herein, it should be understood that these terms have reference only to the structure shown in the drawings as it would appear to a person viewing the drawings and are utilized only to facilitate describing the invention.

DESCRIPTION OF THE PREFERRED EMBODIMENT

As can be seen in the Figures, a pipe indicated by the reference numeral 10 has been shown. Pipe 10 may be formed of carbon steel and specifically in the most preferred form is a pup joint certified by the American Petroleum Institute for installation in an oil well casing pipe 12, pipe 10 having been hatched for metal. Also, pipe 10, in practice, may vary considerably in diameter depending upon the diameter of casing pipe 12. The manner in which various pipe diameters are accommodated will become clear as the description progresses.

In juxtaposition with pipe 10 is apparatus denoted generally by the reference numeral 14. Apparatus 14 includes a housing 16 including a cylindrical portion 18 and first and second frustoconical portions 20 located on opposite axial sides of and partially closing cylindrical portion 18. In the most preferred form, cylindrical portion 18 has inside and outside surfaces having circular cross sections of diameters slightly larger than the diameter of the circular cross section of the outer surface of pipe 10. In the most preferred form, the inside surface of portion 18 has a diameter in the order of 1 inch (2.54 cm) larger than the outer surface of pipe 10. Portion 18 has an elongated length in the order of 7–9 inches (18–23 cm). Portions 20 each includes a major base having inside and outside surfaces having circular cross sections of diameters equal to and interconnected to the diameters of the inside and outside surfaces of an axial end of portion 18. Portions 20 each include a minor base having an inside surface having a circular cross section of a diameter generally equal and corresponding to the outer surface of pipe 10. In the most preferred form, housing 16 is divided into first and second longitudinal portions **16*a* and 16*b* which are radially separable from each other and pipe 10, with portions 16*a* and 16*b*** being halves in the most preferred form which are mirror images of each other and preferably are of identical construction.

Housing 16 further includes a plurality of parallel spacers 22 for holding cylindrical portion 18 generally concentric to pipe 10. Specifically, in the most preferred form, spacers 22 are elongated angle irons including a first leg 24 secured to the inside surface of cylindrical portion 18 at circumferentially spaced locations such as by welding and a second leg 26 extending perpendicularly from leg 24 and having a free edge for abutting with pipe 10. The free edges of spacers 22 terminate in a cylinder having a diameter generally equal to the diameter of the outer surface of pipe 10. Spacers 22 have an axial length generally equal to and coextensive with the axial length of cylindrical portion 18. Spacers 22 are circumferentially spaced around pipe 10 and extend generally parallel to the axis of pipe 10 and of cylindrical portion 18. In the preferred form, each housing half **16*a* and 16*b* includes first and second edge spacers 22 located adjacent to the longitudinal edges thereof, with the free edges of legs 24 being located circumferentially outward of legs 26. Furthermore, each housing half 16*a* and 16*b* further includes at least one intermediate spacer 22 located intermediate the first and second edge spacers 22 and the longitudinal edges of halves 16*a* and 16*b*. The number of intermediate spacers 22 depends upon the diameter of pipe 10 and cylindrical portion 18, with three spacers 22 shown in the drawings for each housing half 16*a* and 16*b* for pipe 10** having a diameter of 2⅝ inches (6⅔ cm).

Apparatus 14 further includes a first series of permanent magnets 28 located at equally spaced circumferential intervals intermediate pipe 10 and cylindrical portion 18 with magnets 28 being arranged having their south poles located radially inwardly and adjacent pipe 10 and having their north poles located radially outwardly and adjacent cylindrical portion 18. Apparatus 14 further includes a second series of permanent magnets 30 located at equally spaced circumferential intervals intermediate pipe 10 and cylindrical portion 18 with magnets 30 being arranged having their north poles located radially inwardly and adjacent pipe 10 and having their south poles located radially outwardly and adjacent cylindrical portion 18. Magnets 30 are longitudinally spaced along pipe 10 and cylindrical portion 18 from magnets 28. The number and longitudinal positioning of magnets 30 correspond to the number and longitudinal position of magnets 28. The number of magnets 28 and 30 in each series depends upon the diameter of pipe 10 and cylindrical portion 18, with two magnets 28 and 30 shown in the drawings for each half **16*a* and 16*b* positioned intermediate the edge spacers 22 and the intermediate spacer 22 for pipe 10 having a diameter of 2⅝ inches (6⅔ cm). Magnets 28 and 30 in the preferred form are formed of neodymium material in the shape of a right parallelepiped having a height of ¾ inch (1.9 cm) along the longitudinal direction, i.e. the distance between the top and bottom edges of magnets 28 and 30, a width of ½ inch (1.27 cm) along a radial direction, i.e. the distance between the inner and outer edges of magnets 28 and 30, and a thickness of ¼ inch (0.64 cm) along a circumferential direction with reference to pipe 10 and cylindrical portion 18, i.e. the distance between the first and second faces of magnets 28 and 30. It can then be appreciated that the height of magnets 28 and 30 is generally equal to but larger than the width and that the width is substantially greater and in the most preferred form double the thickness of magnets 28 and 30**.

Now that the basic construction of apparatus 14 according to the preferred teachings of the present invention has been explained, the manner of installation of apparatus 14 to pipe 10 and of pipe 10 including apparatus 14 within casing pipe 12 can be set forth. Specifically, housing halves **16*a* and 16*b* including spacers 22 can be fabricated for the particular diameter of pipe 10 to be utilized. The desired number of magnets 28 and 30 corresponding to the particular diameter of pipe 10 can then be magnetically attached at the appropriate circumferential spacing around pipe 10, with magnets 28 and 30 being longitudinally spaced along pipe 10. At that time, housing halves 16*a* and 16*b* can be positioned on pipe 10 with magnets 28 and 30 positioned circumferentially spaced from spacers 22 and with their longitudinal free edges abutting. At that time, a clamping band 32 can be positioned around cylindrical portion 18 of housing 16 and tightened to tightly clamp housing halves 16*a* and 16*b* together with sufficient force to secure apparatus 14 to pipe 10 generally by frictional forces between apparatus 14 and pipe 10. At that time, housing halves 16*a* and 16*b* can be secured together such as by welding 34 the longitudinal free edges of halves 16*a* and 16*b* together. Alternately, plates can be welded to each frustoconical portion 20 overlapping the longitudinal free edges thereof, with the plates not exceeding the diameter of cylindrical portion 18. It can then be appreciated that magnets 28 and 30 are tightly sandwiched between the inside surface of cylindrical portion 18 and the outer surface of pipe 10. Further, it can be appreciated that frustoconical portions 20 close the spacing between the inside surface of cylindrical portion 18 and the outer surface of pipe 10 on the opposite axial ends of cylindrical portion 18**.

In the most preferred form, apparatus 14 is not in any way welded or otherwise secured to pipe 10 in a manner which would affect the physical characteristics thereof and specifically which would affect the certification of pipe 10. However, apparatus 14 is very rigidly secured to pipe 10 according to the preferred teachings of the present invention. Specifically, removal of apparatus 14 in a radial direction is prevented due to the securement of halves **16*a* and 16*b* together and concentrically around pipe 10. Sliding of apparatus 14 in a longitudinal direction is prevented due to the abutment and clamping of the minor base of portions 20 and of the free edges of legs 26 of spacers 22 against the outer surface of pipe 10. Additionally, the sandwiching of magnets 28 and 30 between cylindrical portion 18 and pipe 10 also assists in the securement of apparatus 14 to pipe 10. Thus, according to the teachings of the present invention, a standard, previously certified pipe 10 can be purchased, with apparatus 14, according to the preferred teachings of the present invention, being added thereto without requiring pipe 10** to be retested or certified prior to installation.

Pipes 10 with apparatus 14 secured thereto, according to the preferred teachings of the present invention, can then be transported to the oil well. The well pipe tubing can then be installed in casing pipe 12 in the usual manner and including pipe 10 and apparatus 14 secured thereto at approximately 1,000 feet (300 meters) intervals along the well pipe tubing. It should be appreciated that due to the very tight manner that apparatus 14 grips pipe 10 and the reinforcement provided to apparatus 14 by spacers 22, apparatus 14 is able to withstand the rigors of installation in casing pipe 12 without dislodgment from or along pipe 10.

After installation of the well pipe tubing including apparatus 14 at axial spaced intervals, apparatus 14 magnetically treats the flow through the well pipe tubing to prevent and/or eliminate incrustation inside of the well pipe tubing and thus saving maintenance costs and maximizing flow through the well pipe tubing and thus the production from the oil well.

I claim:

1. Apparatus for magnetically treating flowing liquids through a pipe, with the pipe having an outer surface having a circular cross section of a diameter, comprising, in combination: a housing including a cylindrical portion, with the cylindrical portion having inside and outside surfaces having circular cross sections of diameters larger than the diameter of the outer surface of the pipe, with the housing further including a plurality of parallel spacers secured at circumferentially spaced locations to the inside surface of the cylindrical portion and having axial lengths generally equal to the axial length of the cylindrical portion, with the spacers having free edges which terminate in a cylinder having a diameter generally equal to the diameter of the outer surface of the pipe; and means for producing a magnetic field for a liquid flowing through the pipe comprising, in combination: a series of first magnets sandwiched between the inside surface of the cylindrical portion and the outer surface of the pipe, with the first magnets being circumferentially spaced from each other and from the spacers; and a series of second magnets sandwiched between the inside surface of the cylindrical portion and the outer surface of the pipe and axially spaced from the first magnets, with the second magnets being circumferentially spaced from each other and from the spacers, with the first and second magnets each having north and south poles, with the first magnets having the north poles located radially outward of the south poles and the second magnets having the south poles located radially outward of the north poles.

2. The apparatus of claim 1 wherein the housing is secured to the pipe generally by frictional forces between the free edges of the spacers and the outer surface of the pipe and free of any attachment to the pipe.

3. The apparatus of claim 1 wherein the spacers are L-shaped having first legs secured to the inside surface of the cylindrical portion and having second legs integrally extending generally perpendicular to the first legs and terminating in the free edges.

4. The apparatus of claim 1 wherein the magnets have a right parallelepiped shape having a top edge, a bottom edge, an inner edge abutting with the outer surface of the pipe, an outer edge abutting with the inside surface of the cylindrical portion, a first face, and a second face, with the height of the inner and outer edges between the top edge and the bottom edge being generally equal to the width of the first and second faces between the inner and outer edges and being a multiple of the thickness of the top and bottom edges between the first and second faces, with the poles located at the inner and outer edges.

5. The apparatus of claim 4 wherein the width of the first and second faces between the inner and outer edges is double the thickness of the top and bottom edges between the first and second faces.

6. The apparatus of claim 5 wherein the height of the inner and outer edges between the top edge and the bottom edge is larger than the thickness of the top and bottom edges between the first and second faces.

7. The apparatus of claim 1 wherein the housing further includes first and second means for closing the spacing between the inside surface of the cylindrical portion and the outer surface of the pipe on the opposite axial ends of the cylindrical portion.

8. The apparatus of claim 7 wherein the closing means each comprise a frustoconical portion, with the frustoconical portions each including a major base having inside and outside surfaces having circular cross sections of diameters equal to and interconnected to the diameters of the inside and outside surfaces of the cylindrical portion, with the frustoconical portions each including a minor base located axially outward of the cylindrical portion and having an inside surface having a circular cross section of a diameter generally equal to the pipe.

9. The apparatus of claim 1 wherein the housing is divided into first and second longitudinal portions which are radially separable from the pipe, with each of the longitudinal portions including first and second longitudinal edges; wherein the housing includes means for securing the first and second longitudinal portions together with the longitudinal edges of the first longitudinal portion abutting with the longitudinal edges of the second longitudinal portion and with the first and second longitudinal portions being secured together generally without exceeding the diameter of the outside surface of the cylindrical portion and being free of any attachment to the pipe.

10. The apparatus of claim 9 wherein each housing portion includes first and second edge spacers located adjacent to the first and second longitudinal edges and at least a first intermediate spacer located intermediate the first and second edge spacers.

11. The apparatus of claim 9 wherein the housing is secured to the pipe generally by frictional forces between the free edges of the spacers and the outer surface of the pipe.

12. Method for magnetically treating flowing liquids comprising the steps of: providing a pipe including an outer surface having a circular cross section of a diameter; providing a magnetic apparatus producing a magnetic field and including a housing having a cylindrical portion, with the cylindrical portion including an outside surface having generally circular cross sections of a diameter larger than the diameter of the pipe, with the outside surface of the cylindrical portion of the housing having a radial size larger than the remaining portions of the housing, with the magnetic apparatus including the housing being divided into first and second longitudinal portions which are radially separable from the pipe; attaching the first and second longitudinal portions together to secure the magnetic apparatus to the pipe generally by frictional forces between the first and second longitudinal portions and the pipe and being free of attachment of the first and second longitudinal portions to the pipe; and flowing the liquid through the pipe after the magnetic apparatus is secured to the pipe characterized in that the attaching step comprises the steps of: clamping the first and second longitudinal portions on the pipe with sufficient force to secure the magnetic apparatus to the pipe generally by frictional forces between the first and second longitudinal portions and the pipe; attaching the first and second longitudinal portions together generally without exceeding the diameter of the cylindrical portion; and removing the clamping force from the first and second longitudinal portions after the first and second longitudinal portions are attached together.

13. The method of claim 12 further comprising the step of inserting the pipe with the magnetic apparatus secured thereon within a casing pipe, with the pipe and the magnetic apparatus secured thereon having a diametric size less than the casing pipe.

14. The method of claim 13 wherein the clamping step comprises the step of tightening a band around the outside surface of the cylindrical portion.

15. The method of claim 14 wherein the step of providing the magnetic apparatus comprises the step of providing the magnetic apparatus including the housing having the cylindrical portion including an inside surface having circular cross sections of a diameter larger than the diameter of the outer surface of the pipe, with the housing further including a plurality of parallel spacers secured at circumferentially spaced locations to the inside surface of the cylindrical portion and having axial lengths generally equal to the axial length of the cylindrical portion, with the spacers having free edges which terminate in a cylinder having a diameter generally equal to the diameter of the outer surface of the pipe.

16. The method of any claim 14 wherein the step of providing the magnetic apparatus comprises the step of providing the housing further including first and second frustoconical portions, with the cylindrical portion including an inside surface having circular cross sections of a diameter larger than the diameter of the outer surface of the pipe, with the frustoconical portions each including a major base having inside and outside surfaces having circular cross sections of diameters equal to and interconnected to the diameters of the inside and outside surfaces of the cylindrical portion, with the frustoconical portions each including a minor base located axially outward of the cylindrical portion and having an inside surface having a circular cross section of a diameter generally equal to the pipe.

17. The method of any claim 12 wherein the step of providing the magnetic apparatus comprises the step of providing the first and second longitudinal portions each including first and second longitudinal edges having an outer radial size not exceeding the outside surface of the cylindrical portion; and wherein the clamping step includes abutting the longitudinal edges of the first longitudinal portion with the longitudinal edges of the second longitudinal portion.

18. The method of claim 17 wherein the attaching step comprises the steps of welding the first longitudinal edges of the first and second longitudinal portions together and welding the second longitudinal edges of the first and second longitudinal portions together.

19. The method of claim 12 wherein the clamping step comprises the step of tightening a band around the outside surface of the magnetic apparatus.

20. Method for magnetically treating flowing liquids comprising the steps of: providing a pipe including an outer surface having a circular cross section of a diameter; providing a magnetic apparatus producing a magnetic field and including a housing having a cylindrical portion, with the magnetic apparatus including the housing being divided into first and second longitudinal portions which are radially separable from the pipe; attaching the first and second longitudinal portions together and being free of attachment of the first and second longitudinal portions to the pipe, with the magnetic apparatus being secured with sufficient force to the pipe generally by frictional forces between the first and second longitudinal portions and the pipe, with the cylindrical portion having inside and outside surfaces having circular cross sections of diameters larger than the diameter of the outer surface of the pipe, with the magnetic apparatus further including a series of first magnets sandwiched between the inside surface of the cylindrical portion and the outer surface of the pipe, with the first magnets being circumferentially spaced from each other, with the magnetic apparatus further including a series of second magnets sandwiched between the inside surface of the cylindrical portion and the outer surface of the pipe and axially spaced from the first magnets, with the second magnets being circumferentially spaced from each other, with the first and second magnets each having north and south poles, with the first magnets having the north poles located radially outward of the south poles end the second magnets having the south poles located radially outward of the north poles, with the magnetic apparatus further including a plurality of parallel spacers secured at circumferentially spaced locations to the inside surface of the cylindrical portion and having axial lengths generally equal to the axial length of the cylindrical portion, with the spacers having free edges which terminate in a cylinder having a diameter generally equal to the diameter of the outer surface of the pipe, with the first and second magnets being circumferentially spaced from the spacers; and flowing the liquid through the pipe after the clamping force is removed.

21. The method of claim 20 wherein the step of providing the magnetic apparatus comprises the step of providing the magnets of a right parallelepiped shape and having a top edge, a bottom edge, an inner edge abutting with the outer surface of the pipe, an outer edge abutting with the inside surface of the cylindrical portion, a first face, and a second face, with the height of the inner and outer edges between the top edge and the bottom edge being generally equal to the width of the first and second faces between the inner and outer edges and being a multiple of the thickness of the top and bottom edges between the first and second faces, with the poles located at the inner and outer edges.

22. Method for magnetically treating flowing liquids comprising the steps of: providing a pipe including an outer surface having a circular cross section of a diameter; providing a magnetic apparatus producing a magnetic field and including a housing having a cylindrical portion, with the magnetic apparatus including the housing being divided into first and second longitudinal portions which are radially separable from the pipe; and attaching the first and second longitudinal portions together and being free of attachment of the first and second longitudinal portions to the pipe, with the cylindrical portion having inside and outside surfaces having circular cross sections of diameters larger than the diameter of the outer surface of the pipe, with the housing further including a plurality of parallel spacers secured at circumferentially spaced locations to the inside surface of the cylindrical portion and having axial lengths generally equal to the axial length of the cylindrical portion, with the spacers having free edges which terminate in a cylinder having a diameter generally equal to the diameter of the outer surface of the pipe, with the spacers being of an L-shape including first legs secured to the inside surface of the cylindrical portion and having second legs integrally extending generally perpendicular to the first legs and terminating in the free edges; and flowing the liquid through the pipe after the clamping force is removed.

23. Apparatus for magnetically treating flowing liquids through a pipe, with the pipe having an outer surface having a circular cross section of a diameter, comprising, in combination: a housing including a cylindrical portion, with the cylindrical portion having inside and outside surfaces having circular cross sections of diameters larger than the diameter of the outer surface of the pipe, with the housing further including a plurality of parallel spacers secured at circumferentially spaced locations to the inside surface of the cylindrical portion and having axial lengths generally equal to the axial length of the cylindrical portion, with the spacers having free edges which terminate in a cylinder having a diameter generally equal to the diameter of the outer surface of the pipe; and means located between the inside surface of the cylindrical portion and the outer surface of the pipe for producing a magnetic field for a liquid flowing through the pipe, with the spacers being L-shaped and having first legs secured to the inside surface of the cylindrical portion and having second legs integrally extending generally perpendicular to the first legs and terminating in the free edges.

* * * * *

UNITED STATES PATENT AND TRADEMARK OFFICE

CERTIFICATE OF CORRECTION

PATENT NO. : 5,700,376

DATED : December 23, 1997

INVENTOR(S) : Roland K. Carpenter

It is certified that error appears in the above-identified patent and that said Letters Patent is hereby corrected as shown below:

Column 1, line 23, cancel "Of" and substitute therefor --of--.

Column 1, line 28, cancel "that," and substitute therefor --that--.

Column 8, line 45, cancel "end" and substitute therefor --and--.

Signed and Sealed this

Seventeenth Day of March, 1998

*Attest:*

*Attesting Officer*

BRUCE LEHMAN

*Commissioner of Patents and Trademarks*